US005652801A

United States Patent [19]

Paddock

[11] Patent Number: 5,652,801

[45] Date of Patent: Jul. 29, 1997

[54] RESONANCE DAMPER FOR PIEZOELECTRIC TRANSDUCER

[75] Inventor: Paul W. Paddock, McMinnville, Oreg.

[73] Assignee: Aura Systems, Inc., El Segundo, Calif.

[21] Appl. No.: 286,625

[22] Filed: Aug. 5, 1994

Related U.S. Application Data

[63] Continuation-in-part of Ser. No. 236,209, May 2, 1994.

[51] Int. Cl.[6] ..... H04R 25/00

[52] U.S. Cl. ..... 381/190; 381/173

[58] Field of Search ..... 381/190, 202, 381/203, 196, 114, 173; 310/324, 348, 328; 29/594

[56] References Cited

U.S. PATENT DOCUMENTS

| | | | |
|---|---|---|---|
| 1,803,275 | 4/1931 | Sawyer . | |
| 1,821,469 | 9/1931 | Hicks | 181/169 |
| 3,548,116 | 12/1970 | Schafft | 381/190 |
| 3,786,202 | 1/1974 | Schafft | 381/190 |
| 3,941,932 | 3/1976 | D'Hoogh . | |
| 4,029,911 | 6/1977 | Albinger . | |
| 4,389,548 | 6/1983 | Morikawa et al. | 381/190 |
| 4,584,439 | 4/1986 | Paddock . | |
| 4,654,554 | 3/1987 | Kishi | 381/190 |
| 4,903,308 | 2/1990 | Paddock et al. . | |
| 5,054,063 | 10/1991 | Lo et al. . | |
| 5,249,237 | 9/1993 | Paddock . | |

FOREIGN PATENT DOCUMENTS

| | | | |
|---|---|---|---|
| 58-182999 | 10/1983 | Japan . | |
| 0182999 | 10/1983 | Japan | 381/190 |
| 60-143099 | 7/1985 | Japan . | |

*Primary Examiner*—Curtis Kuntz
*Assistant Examiner*—Huyen D. Le
*Attorney, Agent, or Firm*—Lisa A. Merkadeau; Kathy Mojibi

[57] ABSTRACT

An audio transducer is disclosed that has a piezoelectric driving element and a diaphragm configured as a flat, curvilinear plane. A lightweight, rigid bridge element connects the piezoelectric device to the diaphragm. Several bridge configurations are shown that emphasize or reduce various characteristics such as frequency response and vertical dispersion. Also, several diaphragm configurations are disclosed in which the diaphragms have as few as a single diaphragm sheet or as many as four sheets or more. In each case the diaphragm sheets are configured as flat, curvilinear planes. A resonance damper is provided comprising a resilient membrane having a plurality of resilient flaps. The damper is resiliently coupled to the piezoelectric device by arranging adjacent flaps to press against opposite sides of the piezoelectric device.

33 Claims, 7 Drawing Sheets

RESONANCE DAMPER FOR PIEZOELECTRIC TRANSDUCER

CROSS REFERENCE TO RELATED APPLICATION

This application is a continuation-in-part of U.S. patent application Ser. No. 08/236,209, filed May 2, 1994.

BACKGROUND OF THE INVENTION

1. Field of the Invention

The present invention pertains to the field of audio loudspeakers using a piezoelectric device as a driver, and more particularly to a resonance damper for use on such a piezoelectric device.

2. Description of the Related Art

Modern piezoelectric devices are a very reliable and inexpensive means of converting electrical energy into physical motion and exhibit a high tolerance to environmental factors such as electromagnetic fields and humidity.

Accordingly, piezoelectric devices are a logical choice for use in audio transducers. However, to date no one has been able to construct a practical piezoelectric audio loudspeaker having good fidelity characteristics. Although piezoelectric devices have a good frequency response, designers have had limited success in coupling a piezoelectric device to an acoustical diaphragm for producing sound in the manner that produces a high fidelity speaker or microphone. Conversely, piezoelectric devices have been successfully used in audio transducer devices that produce a single or a limited range of frequencies, such as beepers and audio warning signals associated with electronic devices.

One aspect of audio loudspeaker quality can be quantified by its Q factor, which represents the degree to which the speaker components, such as the driver, diaphragm and enclosure, interact to control resonance. Lower Q factors indicate a lower resonant frequency amplitude which is desirable, particularly for high-frequency speakers. Improved audio quality, without degradation of other performance parameters, is always a goal of loudspeaker designs.

A common failure mode of prior art piezoelectric transducers is failure of the connection between the piezoelectric device and the diaphragm due to rough handling or high-impact loads on the speaker enclosure. Attempts to shock mount the piezoelectric device typically resulted in reduced frequency response and poor speaker fidelity.

What is needed then is a resonance damper that improves the Q factor and frequency response of the driver. It is also desirable to provide a means for shock mounting the piezoelectric driver used in audio loudspeakers without affecting the overall fidelity of the loudspeaker.

SUMMARY OF THE INVENTION

The present invention solves the above-noted deficiencies by providing a resonance damper for a transducer to improve frequency response and a means for shock mounting the piezoelectric driver.

The present invention uses a resilient membrane that is resiliently coupled to a piezoelectric device to dampen its resonance frequency, thereby lowering its Q factor and improving the frequency response of the piezoelectrically driven loudspeaker. In one preferred embodiment, the damper is a resilient membrane of closed-cell foam that is die-cut to be generally circular and to have a plurality of flaps. The flaps can be created by cutting a central opening and a plurality of slits, or an opening can be cut in a "daisy" pattern, thereby creating flaps between the lobes of the daisy. The flaps can then be arranged about the piezoelectric device by locating adjacent flaps on opposite sides of the piezoelectric device so that the resilient properties of the flaps hold the device in place and provide the proper dampening characteristics.

The significant advantages of the present invention are that it provides a resonance damper that is inexpensive to manufacture and inexpensive to couple to the piezoelectric device because the membrane comprises a single piece of die-cut foam which can be coupled to the piezoelectric device without any adhesives or mechanical fasteners. Additionally, speaker quality is improved as quantified by its Q factor. Preliminary testing indicates that the damper of the present invention lowers resonance frequency amplitudes by 5–10 dB.

Preferably, the resonance damper of the present invention can be coupled to a loudspeaker that uses a diaphragm having two sheets supported by foam supports. The diaphragm sheets are configured in a convolute configuration which is generally referred to herein as a flat, curvilinear plane, defined as a surface formed by a straight line moving transversely through space along a curved path. The sheets are connected to a bridge, which in turn is connected to a piezoelectric device. The diaphragm, foam supports, bridge and piezoelectric device are preferably mounted in an enclosure. The bridge is preferably a thin, lightweight, rigid structure that transfers a point source of motion to a line, thereby transferring the piezoelectric's point source-of-motion to a line source-of-motion for tangentially driving the diaphragm. When the damper of the present invention is used in loudspeakers having the flat, curvilinear diaphragm and bridge structure, it is preferable that the damper contact the edges of the bridge when it is coupled to the piezoelectric device.

The resonance damper of the present invention can also be used on piezoelectric loudspeakers using cone diaphragms to improve its frequency response and as a shock mounting to prevent failure of the piezo-to-diaphragm connection.

The foregoing and additional features and advantages of the present invention will be more readily apparent from the following detailed description, which proceeds with reference to the accompanying drawings.

DETAILED DESCRIPTION OF THE PREFERRED EMBODIMENTS

Figure 1:
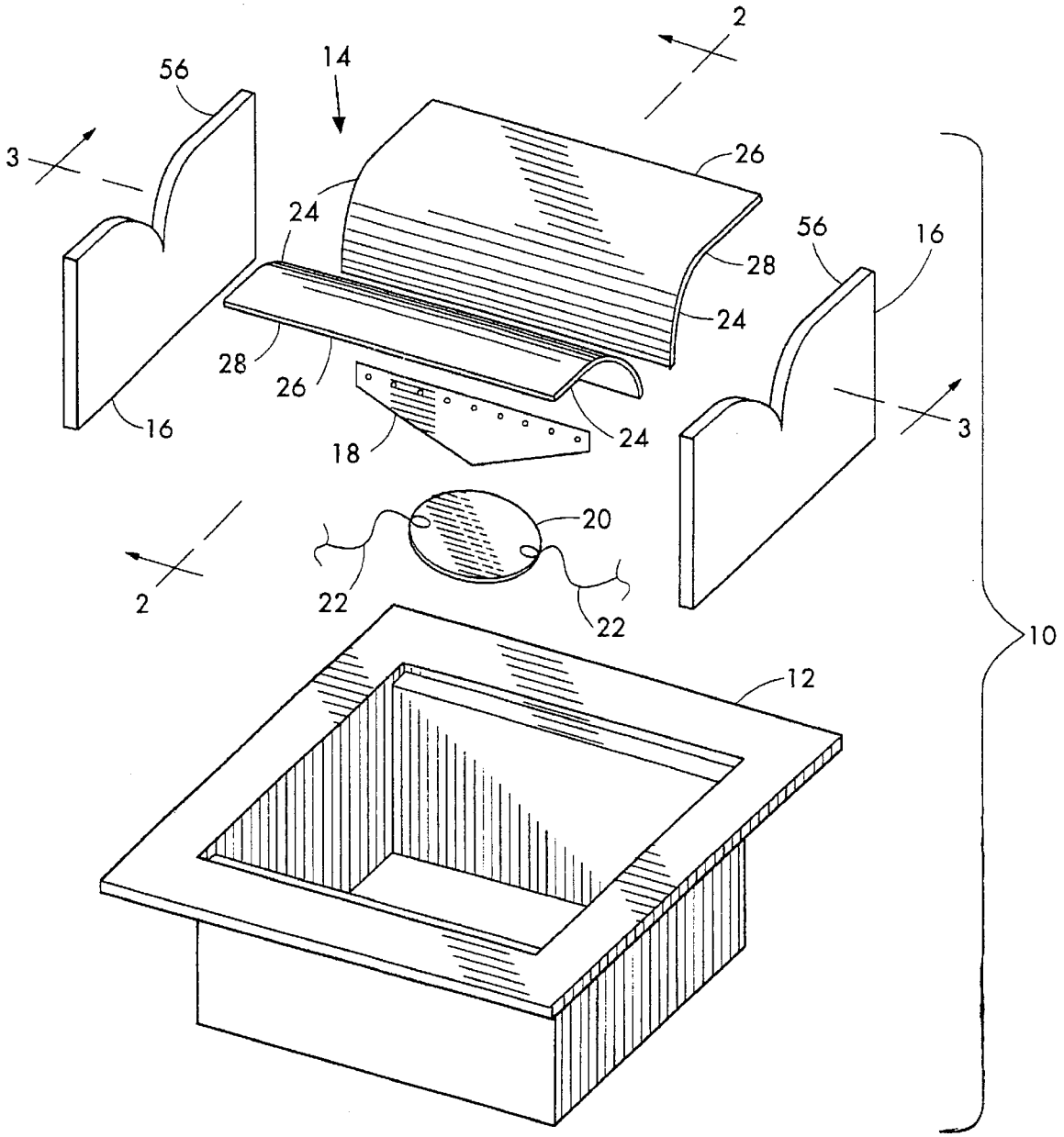
FIG. 1 is an exploded, perspective view showing the components of an audio transducer of the present invention.
Figure 2:
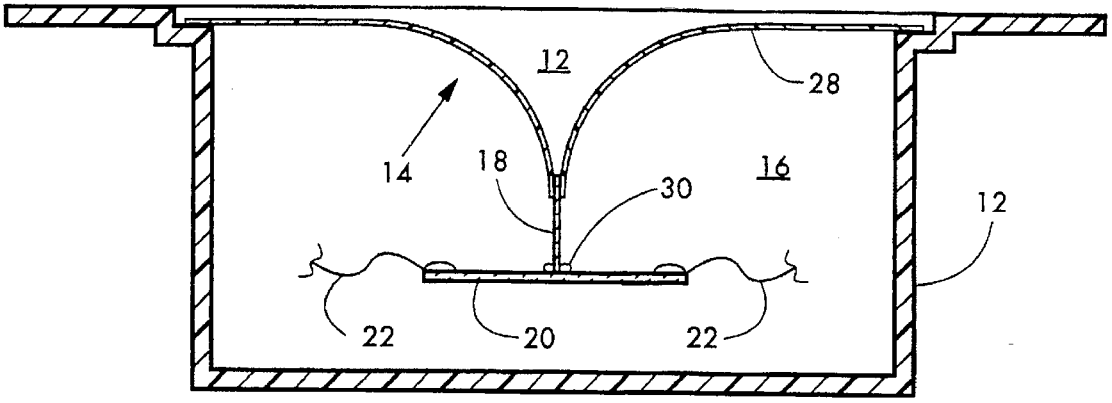
FIG. 2 is a cross-section, elevational view taken along line 2—2 of FIG. 1.
Figure 3:
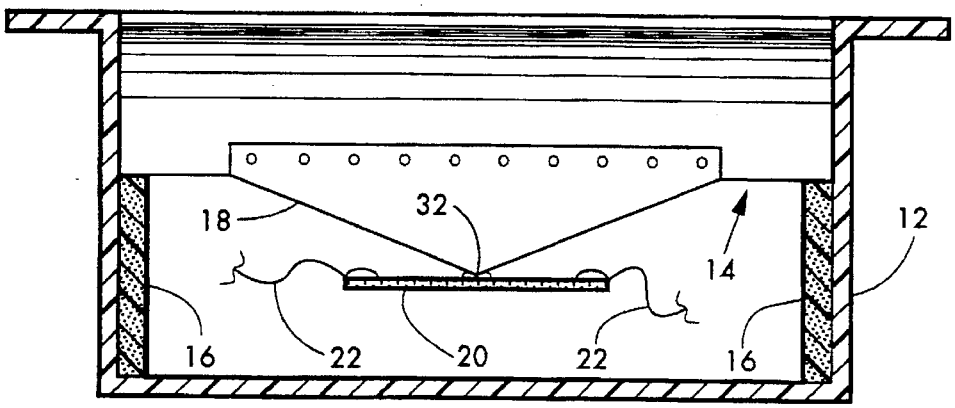
FIG. 3 is a cross-section, elevational view taken along line 3—3 of FIG. 1.

Referring generally to FIGS. 1–3, there is shown a preferred embodiment of an audio transducer 10 of the present invention. The audio transducer 10 has an enclosure 12 and a diaphragm 14 supported by two foam supports 16. Attached to the diaphragm 14 is a bridge 18, which in turn is attached to a piezoelectric device 20 having conductors 22 for connecting to a source of audio signals. The audio transducer 10 is primarily intended for use as an audio loudspeaker and the description of the transducer which follows will be addressed to its use as a loudspeaker. It should be understood, however, that a transducer is also suitable for, and functions quite effectively as, a microphone. Those skilled in the art would be able to easily convert the audio loudspeaker of the present design into a microphone.

As shown in FIGS. 1–3, the diaphragm is supported by the foam supports 16 along margins 24 and is attached to the enclosure 12 along margins 26. In the preferred embodiment shown, the diaphragm has two sheets 28 which connect to the bridge 18 and to each other through perforations in the bridge as will be explained below. The bridge 18 is attached to the piezoelectric device 20 by adhesive 30.

The piezoelectric device 20 is the driver for the audio transducer 10. Piezoelectric devices are well known in the art for their reliability in converting electrical energy into physical motion and vice versa. However, previous attempts to use piezoelectric devices with conventional loudspeaker diaphragms have proved troublesome because the audio fidelity generated by such combinations is poor. However, it has been found that when piezoelectric devices are used as a driver in LINAEUM-style speakers, wherein the diaphragm has one or more sheets arranged as a flat, curvilinear plane, it has proved successful in producing high-fidelity audio loudspeakers. The present invention is particularly useful in providing speakers having good high frequency response, e.g., tweeters. Further experimentation may also reveal advantages for incorporating the present invention into speakers designed for low frequencies and base tones.

In the preferred embodiments disclosed herein, the piezoelectric device 20 is a bimorph bender device manufactured by Motorola Corporation and sold as part number KSN6012A. The bimorph piezoelectric device has thin ceramic discs joined to a conductive material. When supplied with an audio signal, the bimorph piezoelectric device "dishes" in and out. It is also believed that crystals of the PZT family using a three component complex perobskite compound, are also suitable. Other piezoelectric devices include piezo ceramics of the cobalt-lead-niobate family and a unimorphis piezoelectric diaphragm consisting of one circular piezoelectric element and a circular metal plate which are adhered together. Other piezoelectric devices also are available to receive audio signals and produce physical motion, any of which may be suitable for use as a driver in the present invention.

As shown in the preferred embodiments, the piezoelectric device is unsupported within the enclosure 12 except for its adhesive connection to the bridge 18. Alternative embodiments include the use of a mounting pad that would consist of a low density foam connected to the piezoelectric device 20 and the enclosure 12. In this embodiment, the device 20 would be physically connected to the enclosure, not freely suspended. Another alternative embodiment includes the use of a tube having an outside diameter substantially equal to the diameter of the piezoelectric device 20 which is positioned to support the circumference of the piezoelectric device 20 and connect it to the enclosure 12. A soft tube would provide greater fidelity, a rigid tube would provide greater output, but at the expense of fidelity. A resonance damper may also be used as a means for supporting the piezoelectric device as described below. Future development of the present invention may reveal other suitable support structures for supporting the piezoelectric device 20 and are considered within the scope of the present invention.

The bridge 18 is preferably a lightweight, rigid structure whose purpose is to transmit a point source of energy from the piezoelectric device 20 into a line driver for driving the diaphragm 14. One suitable material for the bridge 18 is a glass epoxy board which is generally used in manufacturing flexible printed circuits. Bridges made of the glass epoxy board have a thickness of 5 μm to 13 μm (0.002 inches to 0.005 inches). Furthermore, the glass epoxy board may be easily cut into a desired physical configuration, and it is suitable for attaching to the piezoelectric device 20 with an epoxy adhesive 30.

Figure 4:
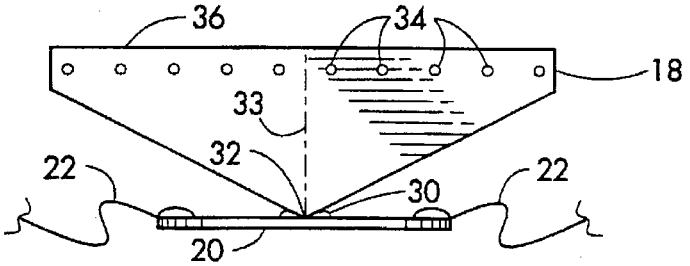
FIG. 4 is a detailed elevational view of a bridge and piezoelectric device of the present invention.

As stated, the purpose of the bridge is to convert a point source of excitation into a line source of excitation for driving the diaphragm 14. Predictably, the shape of the bridge can substantially effect the characteristics of the audio loudspeaker. A preferred embodiment of the bridge uses a shape that is substantially that of a triangle as shown in FIG. 4. It has been found that the optimum relative dimensions of the bridge are such that the ratio of the height 33 to a base margin 36 is between ¼ and ⅙. This preferred embodiment of the bridge also has two margins that form an apex 32 which is adhered to the piezoelectric device 20 by means of the adhesive 30. The bridge also has a line of perforations 34 that extend along margin 36.

The perforations 34 are used to connect the sheets 28 of the diaphragm 14 to the bridge 18 and to each other. As shown most clearly in FIG. 2, the sheets attach to opposite sides of the bridge 18. During fabrication, the sheets 18 will be aligned over the line of perforations 34 on the bridge 18. The sheets are then ultrasonically welded together through the perforations 34 using a suitably configured die. The perforations 34 may be either holes as shown, slits, elongated linear openings or other suitable openings that would permit the sheets 28 to be ultrasonically welded together through those openings. Other methods of connecting the sheets 28 to the bridge 18, such as by adhesive or mechanical connection, are also contemplated and are considered within the scope of the present invention.

Experimentation has shown that the preferred embodiment of the bridge 18 as shown in FIG. 4 may sometimes bow along its margin 36. Such bowing can cause distortion and degrade fidelity. However, such bowing can also improve the vertical dispersion of sound from the loudspeaker. A prototype unit has been shown to have approximately 90° of vertical dispersion which is adequate for many applications. However, some applications require greater dispersion, and alternative bridge configurations may provide greater bowing and thus greater dispersion, although there may be some degradation of low frequency output.

Figure 6:
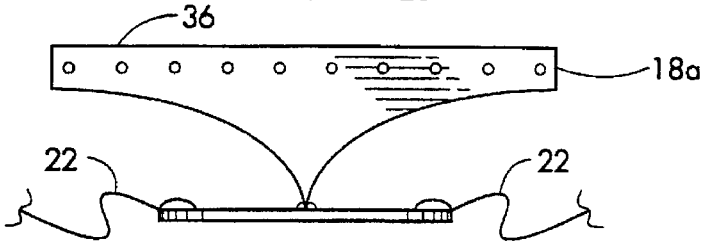
FIG. 6 is an alternative embodiment of a bridge of the present invention.
Figure 7:
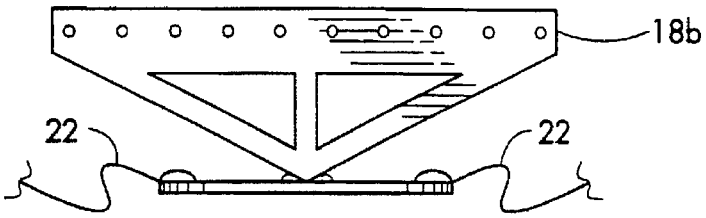
FIG. 7 is an alternative embodiment of a bridge of the present invention.
Figure 8:
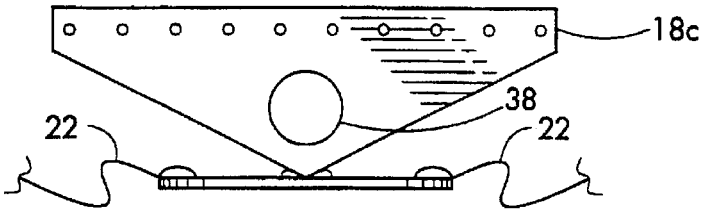
FIG. 8 is an alternative embodiment of a bridge of the present invention.
Figure 9:
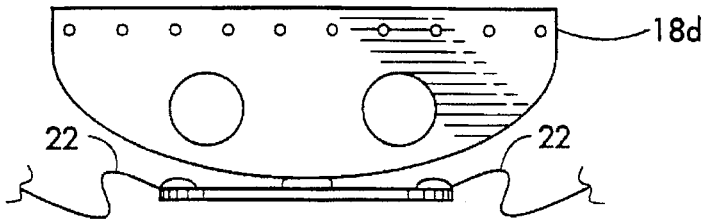
FIG. 9 is an alternative embodiment of a bridge of the present invention.

It also was noted during experimentation that the sound waves generated at the apex 32 of the bridge travel through the bridge structure at an equal rate and therefore reach different parts of the margin 36 at different times. As with the bowing, it is sometimes possible to take advantage of this feature to enhance certain characteristics of the bridge. At other times, it is desirable to defeat this feature in order to enhance other response characteristics. FIGS. 6, 7 and 9 show alternative bridge structures having a solid connection between the apex 32 and the center of margin 36, thereby enhancing the ability of the bridge to transmit sound waves to the center of the margin 36. Conversely, bridge 18*c* shown in FIG. 8 has a large aperture 38 located between the apex 32 and the margin 36 to attenuate the waves travelling from the apex to the center of the margin 36, thereby producing a more even response along the margin 36.

Figure 5:
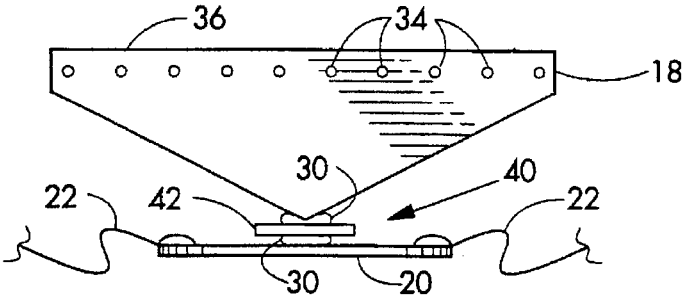
FIG. 5 is an alternative embodiment of a bridge of the present invention further showing a pad located between the bridge apex and a piezoelectric device wherein the pad acts as a low pass filter.

FIG. 5 shows a preferred embodiment of the present invention incorporating a low-pass filter 40 having a filter pad 42. The filter pad 42 comprises a thin pad of foam, preferably a closed-cell dense foam such as neoprene. Thin glue pads (not shown) are adhered to either side of pad 42 for use in connecting the pad to the bridge 18 and the piezoelectric device 20. Preferably, the glue pads are glass epoxy board similar to that used to construct the bridge 18, although other materials may be suitable and are within the scope of the present invention. The low-pass filter is adhered to the bridge 18 and the piezoelectric device using beads of epoxy adhesive 30.

Figure 10:
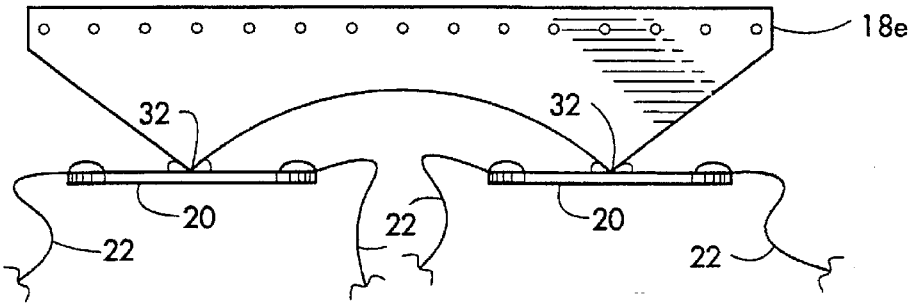
FIG. 10 is an alternative embodiment of a bridge of the present invention having two piezoelectric devices.
Figure 11:
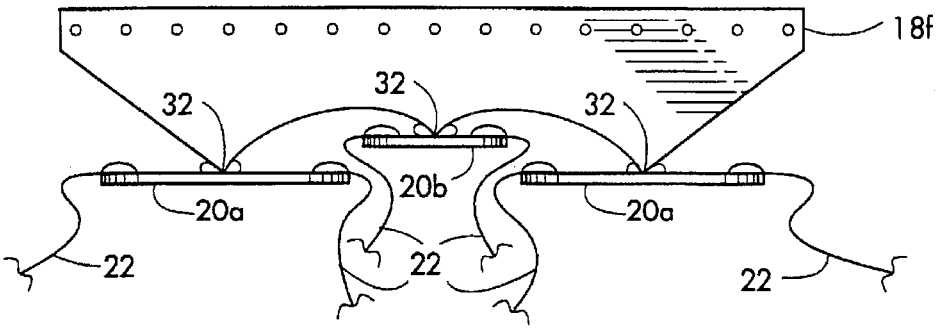
FIG. 11 is an alternative embodiment of a bridge of the present invention having three piezoelectric devices.
Figure 12:
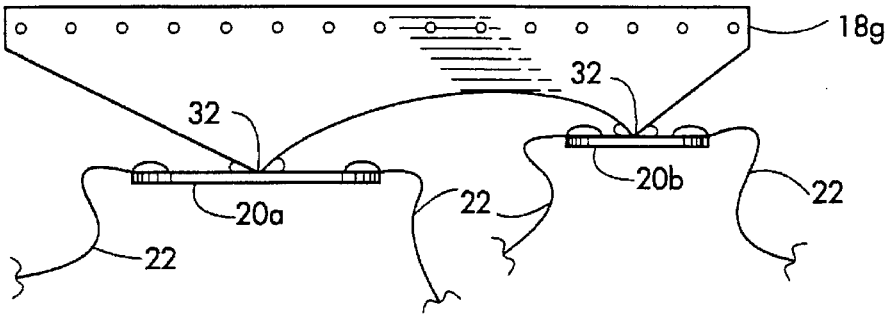
FIG. 12 is an alternative embodiment of a bridge of the present invention having two piezoelectric devices.

FIGS. 10–12 represent alterative embodiments incorporating two or more piezoelectric devices attached to a single bridge. Alternatively, it may be possible to use multiple bridges arranged along a coincident line. FIG. 10 shows a bridge having two apexes 32 to which are mounted two piezoelectric devices 20. This design may be useful for producing greater audio output from the audio transducer 10. FIG. 11 shows a bridge 18*f* having three apexes 32 and two large piezoelectric devices 20*a* and a smaller piezoelectric device 20*b*. This configuration may be useful for providing high-frequency and mid-frequency response. No crossover network would be necessary. It is envisioned that the conductors 22 of all the piezoelectric devices 20*a* and 20*b* would be connected to the same audio source. The smaller piezoelectric device 20*b* would provide greater high frequency response due to its smaller size.

FIG. 12 is a further alternative embodiment showing bridge 18*g* having two apexes 32 which are attached to piezoelectric devices 20*a* and 20*b*. As with the embodiment shown in FIG. 11, the smaller piezoelectric device 20*b* would produce greater higher frequency response while the larger piezoelectric device 20*a* will provide a response at a somewhat lower frequency. The bridges 18*f* and 18*g* shown in FIGS. 11 and 12 are particularly suitable for incorporation of the lowpass filter 40. Preferably, the filter 40 would be used between piezoelectric devices 20*a* and their respective apexes to attenuate higher frequencies.

Figure 13:
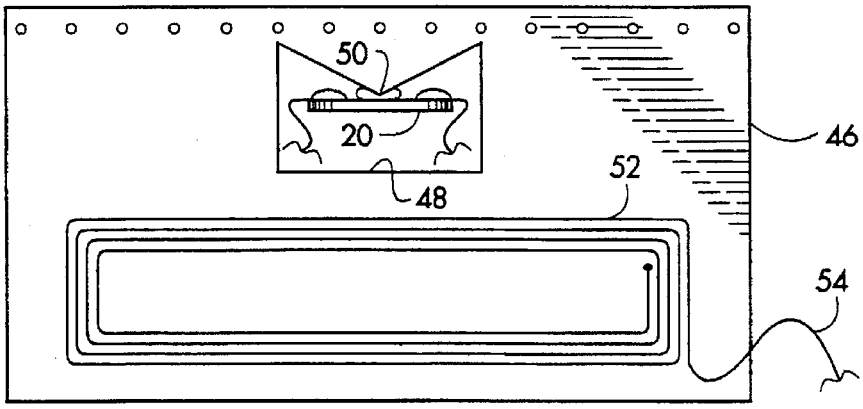
FIG. 13 is an alternative embodiment of a bridge of the present invention further including a coil.

FIG. 13 shows another embodiment of the present invention wherein a bridge 46 has a cutout 48 having two margins that form an apex 50 to which is connected a piezoelectric device 20. Also mounted to the bridge 46 is an electrically conductive coil 52 which can be connected to an audio signal source by one or more conductors such as conductor 54. As previously noted, the prior art includes several other examples of tangentially driven diaphragm speakers using an electromagnetic driver, one example of which is shown in Paddock, U.S. Pat. No. 4,584,439, which is hereby incorporated herein by reference. In the prior art patent, an electrically conductive coil was located between two diaphragm sheets and positioned between a permanent magnet so that when the coil was electrically energized, a magnetic flux was established, thereby moving the diaphragm between the transversely mounted magnets. Similarly, the bridge 46 may be located between a permanent magnetic field, and an audio signal may be supplied to conductor 54, thereby energizing coil 52 to create a variable magnetic flux which will cause bridge 46 to move in response to the changing magnetic flux. The audio signal supplied to the coil may also be supplied to the piezoelectric device 20, thereby driving the audio transducer to provide a more full range of frequency response.

The diaphragm 14 preferably has two sheets 28 each arranged as a flat, curvilinear plane which, for the purposes of the specification and the claims that follow, is defined as a surface defined by a straight line moving transversely through space along a curved path. In the preferred embodiment shown in FIGS. 1–3, each sheet 28 has a relatively simple, single curve, but it is contemplated that other embodiments could incorporate a greater number of, or more complex, curves. It is an important feature of the present invention that the diaphragms are curved in one direction only and remain linear in an orthogonal direction. Referring to FIG. 1, it is seen that the margin 26 is a straight line, whereas the margins 24 form curvilinear lines. The diaphragm sheets 28 are designed such that the surface between the margins 24 of a particular sheet 28 will always be a straight line: thus the designation, flat, curvilinear plane.

As shown in FIGS. 1–3, a preferred embodiment of the present invention has a diaphragm 14 using two sheets 28 incorporating the simple curve as shown. The bridge is located between the sheets such that its major plane is tangent to the curvature of the sheets at the point of its connection to the sheets. In all embodiments of the present invention the bridge will connect to the sheets along a plane substantially tangent to a curvature of the plane of the sheets at the point of connection. Thus, the diaphragms in all embodiments of the present invention are tangentially driven diaphragms.

Figure 14:
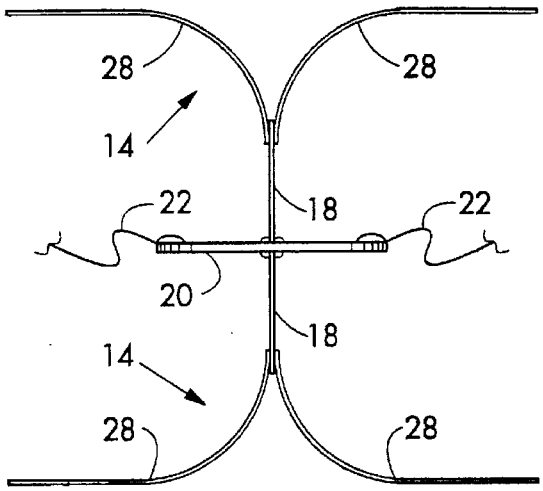
FIG. 14 is an alternative embodiment of a diaphragm configuration of the present invention.
Figure 15:
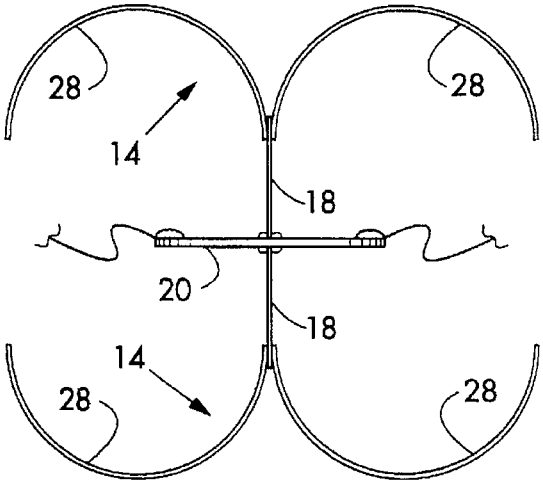
FIG. 15 is an alternative embodiment of a diaphragm configuration of the present invention.
Figure 16:
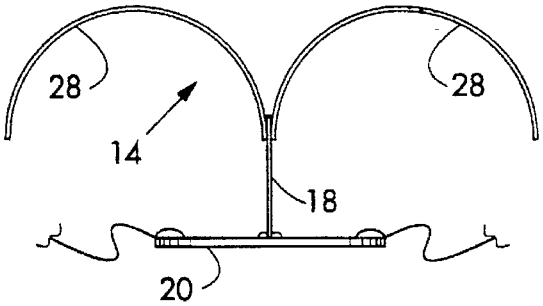
FIG. 16 is an alternative embodiment of a diaphragm configuration of the present invention.
Figure 17:
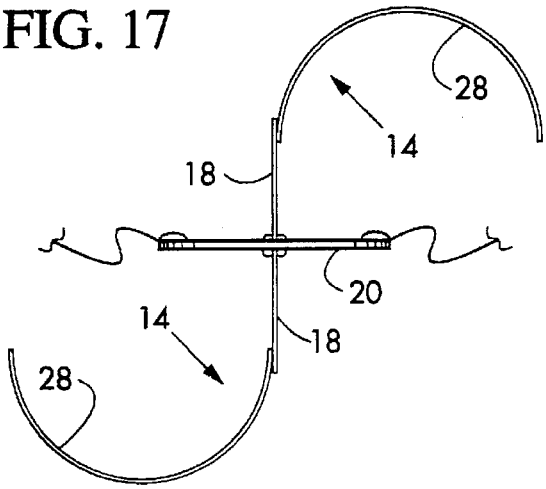
FIG. 17 is an alternative embodiment of a diaphragm configuration of the present invention.
Figure 18:
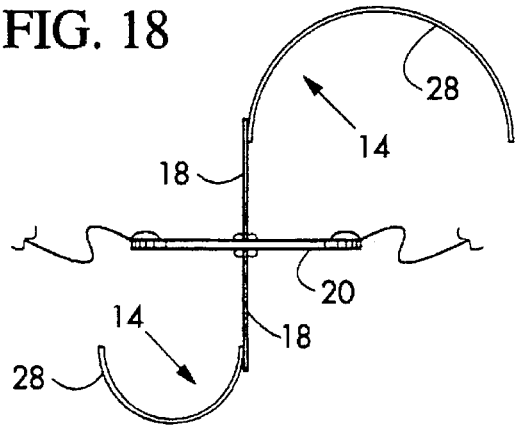
FIG. 18 is an alternative embodiment of a diaphragm configuration of the present invention.

Alternative embodiments of the diaphragm 14 are shown in FIGS. 14–18. FIG. 14 shows two diaphragms 14 having a total of four sheets 28 which are mounted to two individual bridges 18 which are adhered to opposite sides of a single piezoelectric device 20. FIG. 15 represents another double diaphragm configuration wherein diaphragm sheets 28 have a greater degree of curvature. FIG. 16 discloses another embodiment similar to that shown in FIG. 1, but wherein the sheets 28 have a greater degree of curvature. FIGS. 17 and 18 disclose further embodiments wherein a single diaphragm sheet 28 is mounted to a single bridge on one side of a piezoelectric device 20, and the configuration is repeated on the opposite side. FIG. 18 is similar to that of FIG. 17 except that one of the sheets 28*a* is a different size. Alternatively, the configurations shown in FIGS. 17 and 18 could comprise a single sheet and a single bridge mounted to only one side of the piezoelectric device 20.

A preferred material for the diaphragm sheets 28 is polypropylene film. Alternative films that are suitable for the sheets 28 include polyvinylhalides and polyalkylenes. It will be appreciated that other diaphragm materials also may be used.

The foam supports 16 are mounted within the enclosure 12 and support the diaphragm 14. As shown in FIG. 1, the foam support 16 is a flat plane having a margin 56 that is configured to the preferred shape for the sheets 28 of the diaphragm 14. Preferably, the foam supports 16 are of a closed-cell foam such as neoprene or urethane. A foam sold under the brand name PORON has proved satisfactory in prototype units. The desirable properties for the foam are that it be die-cuttable and attenuate sound energy. In an alternative embodiment foam supports are used to support margins 26 and margins 24.

The enclosure 12 is preferably of a molded plastic and may have any shape suitable to enclose and contain the components of the loudspeaker. Alternatively, it is contemplated that the loudspeaker could comprise only the diaphragm 14, bridge 18, support 16 and piezoelectric device 20 mounted onto a foam backing so that it could be easily adhered to any surface.

Figure 19:
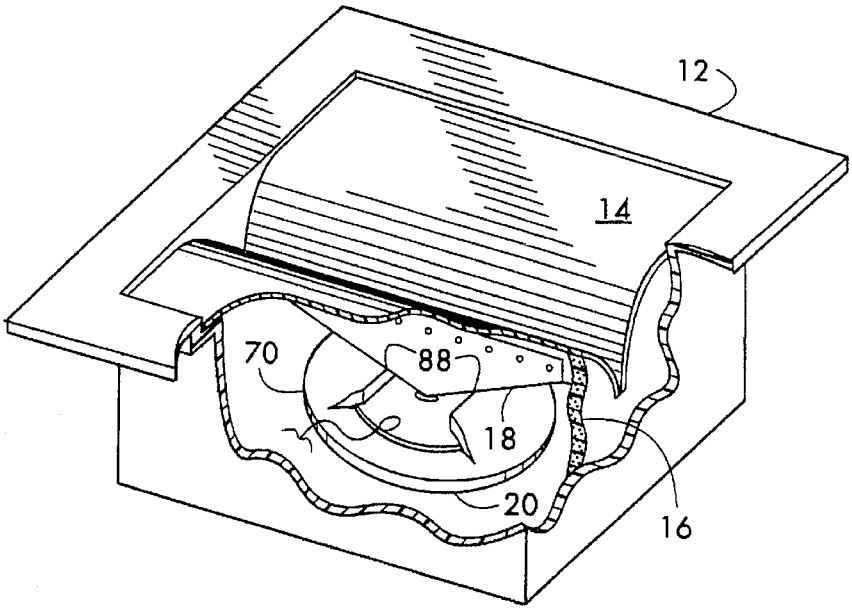
FIG. 19 is a partially cut away, perspective view of an audio transducer of the present invention having a resonance damper mounted onto a piezoelectric driver.

With reference to FIG. 19, there is shown a preferred embodiment of a resonance damper 70 of the present invention coupled to the piezoelectric device 20. Although the resonance damper 70 is shown as a part of a tangentially driven diaphragm speaker, it is to be understood that the resonance damper could be used in connection with any audio transducer having a piezoelectric driver. The resonance damper 70 may be particularly useful with piezoelectric devices used in audio transducers having cone diaphragms because the diaphragm is typically somewhat rigid, and the point of connection between the diaphragm and the piezoelectric device is susceptible to fracture when subjected to impact loads. The resonance damper of the present invention provides a means of shock mounting the piezoelectric device and improving frequency response simultaneously.

Figure 20:
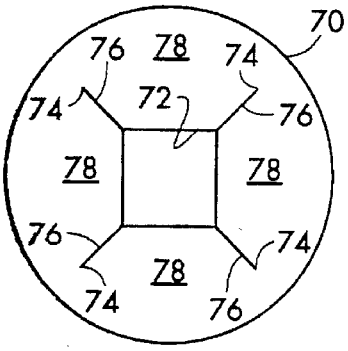
FIG. 20 is a plan view of an embodiment of a resonance damper of the present invention.
Figure 21:
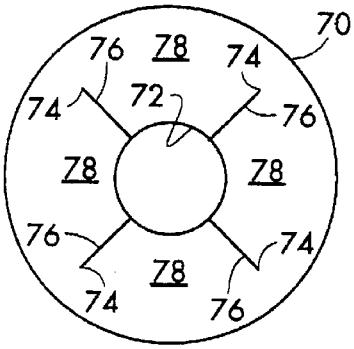
FIG. 21 is a plan view of an alternative embodiment of a resonance damper of the present invention.
Figure 22:
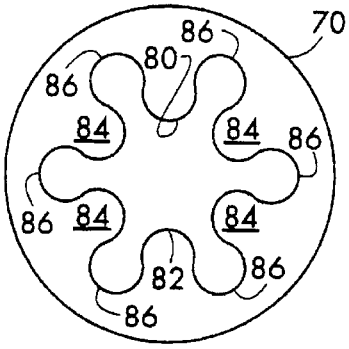
FIG. 22 is a plan view of an alternative embodiment of a resonance damper of the present invention.

FIGS. 20–24 show preferred embodiments for the resonance damper 70 of the present invention. In the embodiments of FIGS. 20–22, the resonance damper 70 is a generally circular, resilient membrane with a centrally located aperture 72. The aperture 72 can be almost any shape but must be sized less than the diameter of the piezoelectric device for which the damper is intended so that the piezoelectric damper will not fit through an unstretched aperture. The shape of the central aperture 72 may be based upon such factors as the ease of cutting and mounting the damper onto the piezoelectric device. Conversely, further experimentation may provide empirical data that indicates superior performance of a particular shape (e.g. circular, triangular, etc.)

A plurality of slits 76 extend radially outward from the apertures 72 forming a plurality of flaps 78. The distance between outermost ends of the slits must be greater than the diameter of the piezoelectric device so that the device will fit between the flaps, as described below. Additionally, the aperture, flaps and damper thickness are suitably sized so that the damper touches the bridge 18 at the points 88. The membrane comprising the damper 70 is essentially planar and made of a resilient material. Because the flaps are cut from the resilient membrane, they are resiliently biased to maintain the planar configuration of the membrane.

FIG. 22 shows a resonance damper 70 having a central aperture 80 that will be referred to as "daisy" shaped. The aperture 80 has an undulating margin 82 that forms a plurality of flaps 84. As with the embodiments shown in FIGS. 20 and 21, a central portion of the aperture 80 must be sized smaller than the diameter of the piezoelectric device to which the damper is to be attached, but the diametric distance between two opposing ends 86 must be greater than the diameter of the piezoelectric device.

Figure 23:
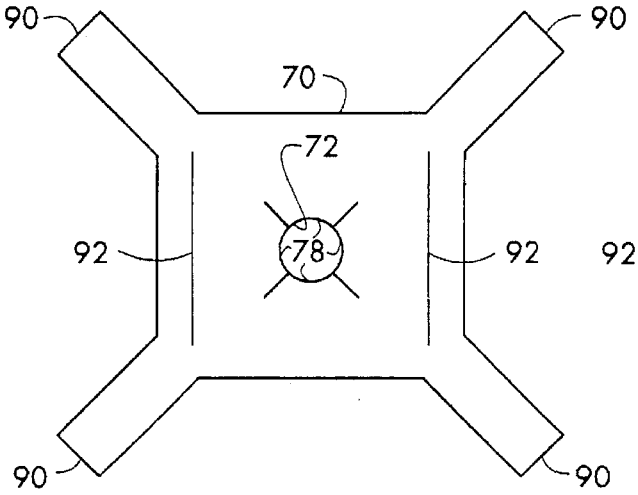
FIG. 23 is a plan view of an alternative embodiment of a resonance damper of the present invention.
Figure 24:
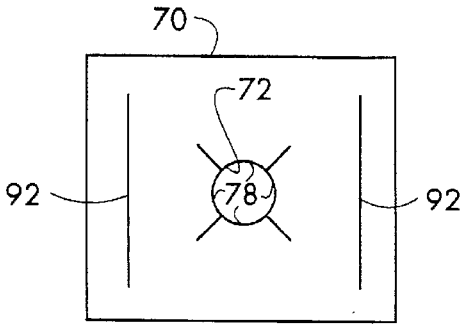
FIG. 24 is a plan view of an alternative embodiment of a resonance damper of the present invention.

FIG. 23 shows a resonance damper 70 having the central aperture 72 and a plurality of flaps 78 configured similarly to the resonance damper shown in FIG. 21. The resonance damper 70 of FIG. 23 further has a plurality of outwardly extending tabs 90 and a pair of slits 92. Similarly, FIG. 24 shows a resonance damper 70 having central aperture 72, flaps 78 and slits 92. Slits 92 are for receiving margins 26 of the diaphragm sheets 28 as seen most clearly in FIG. 26. The resilient nature of the membrane of damper 70 is sufficient to hold the diaphragm sheets 28 between the slits 92. However, it may be desirable to use an adhesive to hold the sheets 28 in place within the slits 92.

Figure 25:
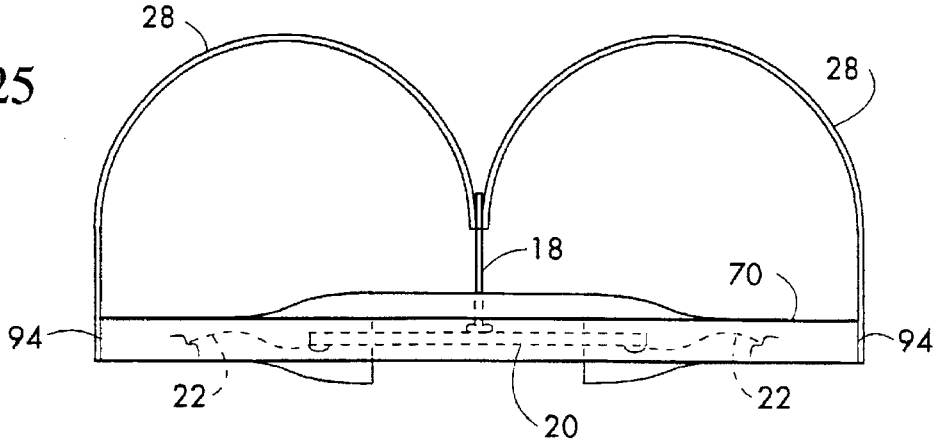
FIG. 25 is a side elevational view of a resonance damper of the present invention coupled to a piezoelectric device of a tangentially driven audio transducer of the present invention.
Figure 26:
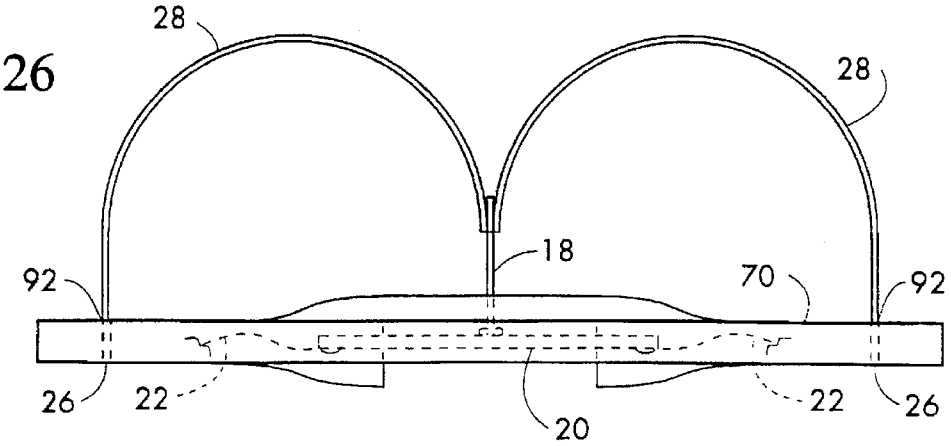
FIG. 26 is a side elevational view of the resonance damper of FIG. 24 coupled to a tangentially driven audio transducer of the present invention.

FIG. 25 represents an alternative embodiment wherein the damper 70 is configured substantially like the damper of FIG. 24 except that it has no slits 92. In the embodiment shown in FIG. 25, the sheets 28 of the diaphragm are adhered to an outside margin 94 of the damper 70. When configured as shown in FIGS. 25 and 26, the resonance damper 70 performs the function of a speaker enclosure such that the audio transducers, as shown in FIGS. 25 and 26, are suitable as stand-alone speakers. Alternatively, the outside edges of the damper 70 may be attached to an enclosure having other speakers or, alternatively, may be attached to a panel such as a car panel.

Returning to the configuration shown in FIG. 23, it can be seen that the piezoelectric device 20, bridge 28, and sheets 28 would be connected to the damper 70 in a manner substantially similar to that shown in FIG. 26. The tabs 90 could then be used as attachment points for mounting the audio transducer of the present invention in an enclosure or on top of a larger, cone speaker wherein the tabs 90 would attach to the speaker's frame and the piezoelectric audio transducer would be suspended across the open front of the larger speaker.

The resonance damper 70 is resiliently coupled to the piezoelectric device 20 by positioning alternate flaps 78 on opposite sides of the piezoelectric device. Thus, the resonance damper is placed alongside an arbitrary surface, for example, a bottom surface, of the piezoelectric device 20, and a flap is pushed up past the piezoelectric device until it can come into position on a top surface of the piezoelectric device. Both adjacent flaps are then left along the bottom surface of the piezoelectric device, but alternating flaps are pushed up and located on the top surface. In this manner, the flaps are alternately positioned on top, then on bottom, then on top, etc. In the embodiments shown in FIGS. 20 and 21, two diametrically opposed flaps 78 would be located on one side of the piezoelectric device 20, and the two adjacent flaps 78 would be located on the opposite side thereof. In the case of the embodiment shown in FIG. 22, three flaps 84 would be located on one side of the piezoelectric device, and three flaps would be located on an opposite side thereof. Preferably, no adhesives are used. The damper and piezoelectric device stay together due to the resilient bias of the flaps.

A multitude of alternative embodiments are contemplated and within the scope of the present invention. For example, the daisy style aperture 80 shown in FIG. 22 may be provided with a greater or fewer number of flaps 84. Likewise, the configurations of FIGS. 20 and 21 may be provided with a greater number of slits providing a greater number of flaps 78. Furthermore, a resonance damper 70 of the present invention could be constructed without a central aperture, but consisting merely of intersecting slits thereby forming a plurality of flaps. In another embodiment of the present invention, it is envisioned that the resilient membrane could be provided with a central aperture, and the foam would be slit along an inside margin of the aperture, thereby cutting the foam thickness in half, in which case the piezoelectric device would be located within the aperture and within the slit, thereby having foam completely encasing an outer periphery of the piezoelectric device.

In the preferred embodiments, the piezoelectric device and resonance damper 70 are freely suspended within the enclosure 12. Alternative embodiments of the present invention could include a tubular or cup-shaped support that would attach to an outer periphery of the resonance damper 70.

In the preferred embodiment, the resonance damper 70 is made of a resilient material such as a closed-cell foam. Experimental resonance dampers of the present invention have been constructed, and have achieved satisfactory results, using foam sold under the brand name PORON available from the Boyd Corporation, Portland, Oreg. Desirable properties for the material include sufficient resiliency to resiliently couple with the piezoelectric device. It is also desirable for the material to be die-cuttable. Other suitable materials include viscoelastic materials and other closed-cell foams.

In view of these and the wide variety of other embodiments to which the principals of the invention can be applied, the illustrated embodiments should be considered exemplary only and not as limiting the scope of the invention.

I claim as the invention all such modifications as may come within the scope and spirit of the following claims and equivalents thereto.

I claim:

1. A resonance damper for a piezoelectric driver used in a loudspeaker comprising a resilient membrane that is resiliently coupled to the piezoelectric driver, the membrane having a plurality of flaps that hold onto the piezoelectric driver by receiving the piezoelectric device between the flaps.

2. The resonance damper of claim 1 wherein the membrane defines an aperture that forms the plurality of flaps for resiliently coupling to the piezoelectric driver.

3. The resonance damper of claim 2 wherein the aperture is an annular opening and a plurality of slits extend from the opening to form the plurality of flaps.

4. The resonance damper of claim 3 wherein the slits are radially oriented.

5. The resonance damper of claim 2 wherein the aperture is a convolute opening having margins that form the plurality of flaps.

6. The resonance damper of claim 1 further including a mounting cup connected to an outer margin of the membrane.

7. The resonance damper of claim 1 wherein the resilient membrane is a closed-cell foam.

8. The resonance damper of claim 1 wherein the membrane further comprises slits for receiving and resiliently coupling a diaphragm associated with an audio transducer.

9. A one-piece damper for damping movement of a piezoelectric device comprising a resilient membrane having an outer margin and an inner portion defining a plurality of resilient flaps for holding the piezoelectric device wherein at least one flap presses against a first surface of the piezoelectric device and another flap presses against a second, oppositely directed surface of the piezoelectric device.

10. The damper of claim 9 wherein the flaps are arranged about the piezoelectric device in an alternating fashion such that adjacent flaps press against the first and second oppositely directed surfaces of the piezoelectric device.

11. The damper of claim 9 wherein the membrane is planer.

12. The damper of claim 9 wherein the membrane is dished after it is resiliently coupled to the piezoelectric device.

13. The damper of claim 9 wherein the outer margin is comprised of a plurality of contiguous linear margins.

14. The damper of claim 9 wherein the outer margin is annular.

15. An audio transducer driver, comprising:

(a) a piezoelectric device; and (b) a resilient membrane defining an aperture that forms a plurality of flaps that resiliently engage first and second oppositely directed surfaces of the piezoelectric device.

16. The audio transducer of claim 15 wherein the aperture is an annular opening and a plurality of slits extend radially from the opening to form the plurality of flaps.

17. The audio transducer of claim 15 wherein the aperture is a convolute opening having margins that form the plurality of flaps.

18. The audio transducer driver of claim 15 wherein the resilient membrane is a closed-cell foam.

19. The audio transducer of claim 15 wherein the membrane further comprises slits for receiving and resiliently coupling a diaphragm associated with the audio transducer.

20. An audio transducer, comprising:

(a) a piezoelectric driver;

(b) a diaphragm having at least one flexible sheet arranged as a flat, curvilinear plane;

(c) a substantially planar bridge having an apex and an opposed substantially linear margin wherein the apex is connected to the piezoelectric driver and the substantially linear margin is connected to the diaphragm and the bridge is located between the piezoelectric driver and the diaphragm; and (d) a resilient membrane resiliently coupled to first and second oppositely directed surfaces of the piezoelectric driver by having portions of the membrane to resiliently press against the oppositely directed surfaces of the piezoelectric driver without an adhesive or a mechanical fastener for providing resonance damping.

21. The audio transducer of claim 20 wherein a major surface of the bridge defines a linear plane that is substantially tangent to a curvature of the flat, curvilinear plane.

22. The audio transducer of claim 20 wherein the bridge has margins that define an apex which is connected to the piezoelectric driver.

23. The audio transducer of claim 20 wherein the bridge defines at least one aperture that is located between the piezoelectric driver and the diaphragm.

24. The audio transducer of claim 20 wherein the membrane defines an aperture that forms a plurality of flaps for resiliently coupling to the piezoelectric driver.

25. The audio transducer of claim 24 wherein the aperture is an annular opening and a plurality of slits extend from the opening to form the plurality of flaps.

26. The audio transducer of claim 25 wherein the slits are radially oriented.

27. The audio transducer of claim 24 wherein the aperture is a convolute opening having margins that form the plurality of flaps.

28. The audio transducer of claim 20 further including a mounting cup connected to an outer margin of the membrane.

29. The audio transducer of claim 20 wherein the resilient membrane is a closed-cell foam.

30. The audio transducer of claim 20 wherein the membrane further comprises slits for receiving and resiliently coupling the diaphragm.

31. A resonance damper for a piezoelectric driver used in a loudspeaker comprising a resilient membrane that is resiliently coupled to first and second oppositely directed surfaces of the piezoelectric driver by having portions of the membrane to resiliently press against the oppositely directed surfaces of the piezoelectric driver so that the damper holds itself onto the driver without mechanical or adhesive fasteners.

32. A resonance damper for a piezoelectric driver used in a loudspeaker comprising a resilient membrane defining an aperture, the aperture defining an inner margin having a slit such that the piezoelectric driver can be partially received in the slit and thus be resiliently coupled to the damper.

33. An audio transducer, comprising:

(a) a piezoelectric driver;

(b) a sheet-like diaphragm arranged as a flat, curvilinear plane having at least one linear diaphragm edge;

(c) a substantially planar bridge having a first linear bridge edge secured to the linear diaphragm edge and a generally opposite second edge, the second edge defining at least one apex affixed to the piezoelectric driver; and (d) a substantially planar resonance damper having at least one interior opening and at least one flap located proximate to the opening to resiliently grip oppositely directed sides of the piezoelectric driver.

* * * * *